United States Patent [19]

Hirose et al.

[11] Patent Number: 4,806,307

[45] Date of Patent: Feb. 21, 1989

[54] ALUMINUM ALLOY WITH SUPERIOR THERMAL NEUTRON ABSORPTIVITY

[75] Inventors: Yagoro Hirose, Saitama; Yoshimitsu Miyagi, Tochigi; Kiko Hirose, Kita; Mitsuo Hino, Tochigi; Masayuki Harada, Aichi; Takehiko Eto, Tochigi; Tetsunari Iida, Hyogo; Masahiro Shimamura, Nagoya, all of Japan

[73] Assignee: Kabushiki Kaisha Kobe Seiko Sho, Kobe, Japan

[21] Appl. No.: 923,223

[22] Filed: Oct. 27, 1986

[30] Foreign Application Priority Data

| | | | |
|---|---|---|---|
| Oct. 25, 1985 | [JP] | Japan | 60-238995 |
| Jan. 30, 1986 | [JP] | Japan | 61-18859 |
| Aug. 1, 1986 | [JP] | Japan | 61-182089 |

[51] Int. Cl.[4] ..... C22C 21/00

[52] U.S. Cl. ..... 420/528; 420/534; 420/537; 420/542; 420/546

[58] Field of Search ..... 420/528, 529, 542, 548, 420/531-535, 537-541, 543-547, 549-553; 148/437, 438, 439, 440

[56] References Cited

FOREIGN PATENT DOCUMENTS 2555611 5/1985 France .
453445 12/1974 U.S.S.R. .

OTHER PUBLICATIONS

Journal of the Less Common Metals, vol. 13, 1967, pp. 431-442; Runnall et al: Phase Equilibria in Aluminium-Rich Alloys of Aluminium-Gadolinium and Aluminium-Terbium.

Metal Science and Heat Treatment, vol. 22, Nos. 9-10, Sep.-Oct. 1980, pp. 743-745, Drits et al: Effect of Rem on the Mechanical Properties of Aluminum Alloys Containing 6.5% Mg.

*Primary Examiner*—R. Dean

*Attorney, Agent, or Firm*—Oblon, Fisher, Spivak, McClelland & Maier

[57] ABSTRACT

An aluminium alloy with superior thermal neutron absorptivity contains 0.2-30 wt. % of Gd. An aluminium alloy for an wrought material with high-temperature strength contains 0.2-20 wt. % of Gd and 0.5-6 wt. % of Mg. An aluminium alloy for casting contains 0.2-10 wt. % of Gd and 6-12 wt. % of Si.

3 Claims, 1 Drawing Sheet

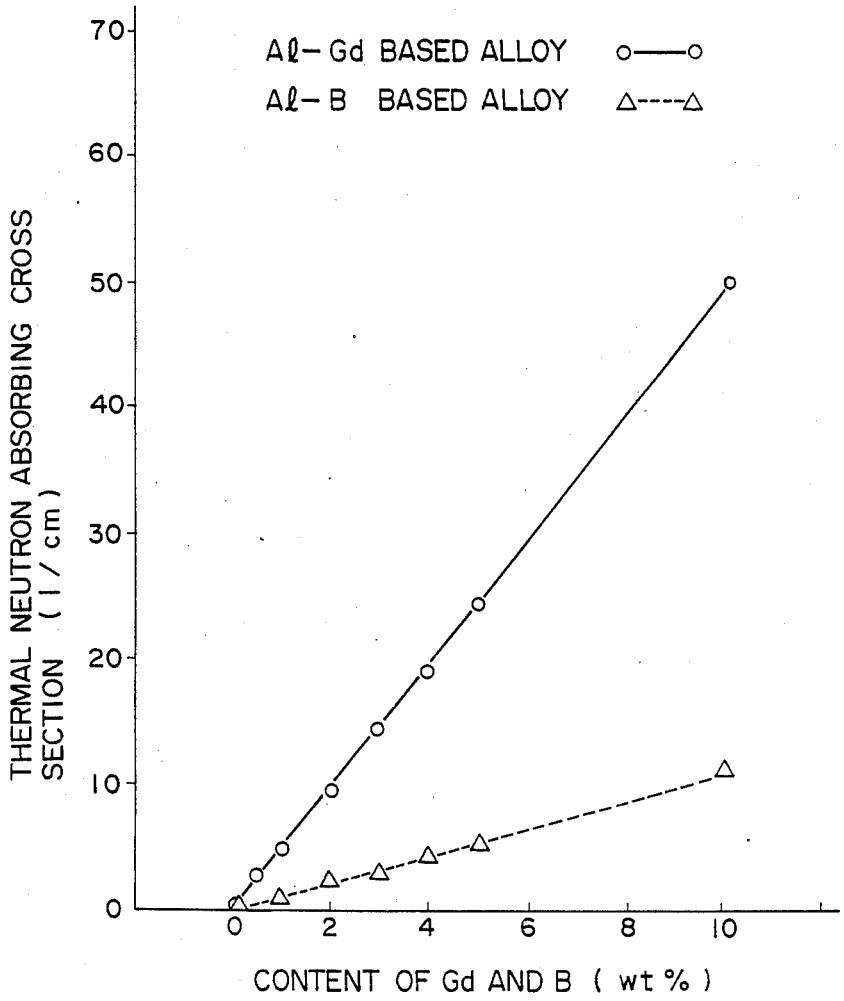
Aℓ– Gd BASED ALLOY
Aℓ– B BASED ALLOY
THERMAL NEUTRON ABSORBING CROSS SECTION (1/cm)
CONTENT OF Gd AND B ( wt % )
0
10
20
30
40
50
60
70
0
2
4
6
8
10

ALUMINUM ALLOY WITH SUPERIOR THERMAL NEUTRON ABSORPTIVITY

BACKGROUND OF THE INVENTION

Generally, in a facility for using a nuclear fuel material and an equipment for transporting the same such as various nuclear reactor facilities, reprocessing facilities and nuclear fuel material storing facilities, it is "security of subcriticality" that is basically required for the nuclear fuel material.

As a fissile material such as 235-U and 239-Pu is easily fissile by a thermal neutron (several eV), it is necessary to absorb the thermal neutron to reduce a thermal neutron flux, thereby enhancing the subcriticality. Thus, in the aforementioned facilities or equipments, metal materials having high thermal neutron absorptivity are widely used.

Especially, in recent years, high enrichment of the nuclear fuel accompanied by high burnup has been promoted in a commercial reactor. Further, in a research reactor, the nuclear fuel of much higher enrichment is used. Therefore, it is necessary to employ metal materials having higher thermal neutron absorptivity for a basket that is used as a fuel storing structure in a spent fuel transporting and storing vessel.

Further, as the basket is subject to high temperature (200°-300° C.) due to decay heat of the spent fuel, the metal materials requires increased high-temperature strength.

The conventional metal materials utilizes superior thermal neutron absorptivity owned by B. Examples of the metal materials may include Boral (trade name by Brooks & Perkins Co.), aluminium alloy bond-casting a mixed sintered material of $B_4C$ and Cu, B-containing aluminium alloy, B-containing stainless steel and B-containing steel.

(1) Boral:

Boral is prepared by sintering a mixture of $B_4C$ and Al, sandwiching the sintered material between Al plates, and rolling the whole. The content of B in the sintered material is high, but it is reduced because the sintered material is sandwiched between the Al plates. If $B_4C$ is increased, workability is remarkably deteriorated. Therefore, the content of $B_4C$ is about 3.5 wt.% at present.

(2) Aluminium alloy bond-casting a mixed sintered material of $B_4C$ and Cu:

The content of $B_4C$ is required to be increased for the purpose of enhancing the thermal neutron absorptivity. However, if the content of $B_4C$ is increased, the sintered material is embrittled, and cannot be shaped. The content of B in the sintered material is about 28 wt.%, but the content is reduced because the sintered material is bond-casted in the aluminium alloy. Furthermore, when the sintered material of $B_4C$ and Cu is bond-casted, there is generated gas from the sintered material. As a result, it is difficult to obtain a desired ingot.

(3) B-containing aluminium alloy:

Al-B alloy wrought material and casting containing 2-5 wt.% of B are used at present. Segregation of B is remarkable, and uniform composition is hard to obtain. Further, as a melting point is remarkably increased by adding B into Al, it is considered that the mass-produceable content of B is 5 wt.% or less, and it is hard to obtain an aluminium alloy containing B of more than 5 wt.%.

(4) B-containing stainless steel and B-containing steel:

These materials are a stainless steel containing B and a carbon steel containing B. As the content of B increases, workability is deteriorated, and hot forging or hot rolling is greatly difficult. Further, a mechanical property at room temperatures is deteriorated. Therefore, at present, the content of B is obliged to be limited to 2 wt.% or less for the carbon steel, and less than 2 wt.% for the stainless steel.

In this way, the Al alloy and the Fe alloy containing B as a thermal neutron absorbing material are practically used at present. However, in any of these materials, if the content of B is increased to enhance the thermal neutron absorptivity, material characteristics are deteriorated, and difficulty in manufacturing is increased. In contrast, the metal materials having good material characteristics contain little content of B to cause low thermal neutron absorptivity.

SUMMARY OF THE INVENTION

It is an object of the present invention to provide an aluminium alloy with superior thermal neutron absorptivity, which is improved in castability, extendability and formability to thereby make manufacturing of a structure easy.

It is another object of the present invention to provide an aluminium alloy with superior thermal neutron absorptivity, which is improved in material characteristics such as mechanical property, high-temperature strength, corrosion resistance and weldability as required by the structure.

The aluminium alloy according to the first invention contains 0.2-30 wt.% of Gd (Gadolinium).

The aluminium alloy according to the second invention contains 0.2-30 wt.% of Gd, and at least one selected from the group consisting of 3 wt.% or less of B, 2 wt.% or less of Li, 6 wt.% or less of Mg, 15 wt.% or less of Si, 5 wt.% or less of Zn, 5 wt.% or less of Cu, 2 wt.% or less of Mn, 1 wt.% or less of Cr, 1 wt.% or less of Zr, 1 wt.% or less of V, 1 wt.% or less of Ti, and 3 wt.% or less of Ni.

The aluminium alloy with superior high-temperature strength for an wrought material according to the third invention contains 0.2-20 wt.% of Gd, 0.5-6 wt.% of Mg, and at least one selected from the group consisting of 1 wt.% or less of Mn, 0.3 wt.% or less of Cr, 0.3 wt.% or less of Zr, 0.3 wt.% or less of V, 2 wt.% or less of B, 2 wt.% or less of Li, 1 wt.% or less of Si, 1 wt.% or less of Zn, 1 wt.% or less of Cu, 2 wt.% or less of Ni, and 0.5 wt.% or less of Ti.

The aluminium alloy with superior high-temperature strength for casting according to the fourth invention contains 0.2-10 wt.% of Gd, 6-12 wt.% of Si, and at least one selected from the group consisting of 1.0 wt.% or less of Cu, and 1.0 wt.% or less of Mg.

BRIEF DESCRIPTION OF THE DRAWING

The FIGURE shows the relationship between the content of Gd and the thermal neutron absorbing cross-section, and also shows the relation between the content of B and the thermal neutron absorbing cross-section.

There will be now described in detail the aluminium alloy with superior thermal neutron absorptivity and high-temperature strength according to the present invention, and a method of producing the same.

Gd is an important element indispensable to provide the thermal neutron absorptivity. If the content of Gd is less than 0.2 wt.%, the effect is little, and the thermal neutron absorptivity is less than that in the conventional material. If the content is greater than 30 wt.%, formability such as rolling and extrusion is deteriorated, and a satisfactory product cannot be obtained. Further, in the case that the aluminium alloy is used for a casting, castability is deteriorated to make the production difficult. Simultaneously, segrigation of Gd is remarkable, and cavity is increased. As a result, uniformity of the thermal neutron absorptivity and strength of the product is greatly reduced. Therefore, the content of Gd is limited to 0.2–30 wt.%. If a large amount of Gd is added to Al molten metal, oxidation remarkably occurs, and castability is deteriorated. Accordingly, the content of Gd is preferably 20 wt.% or less. Particularly, in the case of casting, the content is preferably 10 wt.% or less. FIG. 1 shows the relation between the content of Gd (wt.%) and thermal neutron absorbing cross section (l /cm), also showing the relation between the content of B and the thermal neutron absorbing cross section (l /cm).

B is a component having the thermal neutron absorptivity similar to Gd, and exhibits a synergetic effect in combination with Gd. B functions to finely and uniformly disperse a crystal of $Al_3Gd$ existing in Al-Gd alloy to reduce deflection of the thermal neutron absorptivity. If the content of B exceeds 3 wt.%, castability is greatly deteriorated, and the effect of dispersing the crystal of $Al_3Gd$ finely and uniformly is saturated. Therefore, the content of B is limited to 3 wt.% or less. If the content is 3 wt.% or more, high-temperature strength is reduced, and therefore, the content is preferably 3 wt.% or less.

Li is a component having the thermal neutron absorptivity similar to B, and contributes to the improvement in strength of Al-Gd alloy. If the content of Li exceeds 2 wt.%, castability and formability such as rolling and extrusion are remarkably deteriorated, and extendability and ductility are also reduced. As a result, performance for a structural material is lost. Therefore, the content of Li is limited to 2 wt.% or less.

Mg is a component necessary for providing strength and high-temperature strength for the structural material such as a basket. If the content of Mg exceeds 6 wt.%, corrosion resistance such as stress corrosion cracking resistance and separation corrosion resistance, formability such as rolling and extrusion, and weldability are deteriorated. Therefore, the content of Mg is limited to 6 wt.% or less.

The Al-Gd-Mg alloy for an extended material according to the third invention contains at least 0.5 wt.% of Mg. The Al-Gd-Si alloy for casting according to the fourth invention is required to contain at least 0.1 wt.% of Mg. However, if Mg is excessively contained, extendability is reduced, and therefore, the content of Mg is preferably 1.0 wt.% or less.

Si is an element required for providing strength and high-temperature strength, and contributes to the improvement in castability for casting. If the content of Si exceeds 15 wt.%, formability such rolling and extrusion, castability, and machinability are deteriorated. Therefore, the content of Si is limited to 15 wt.% or less.

The Al-Gd-Si alloy according to the fourth invention contains at least 6 wt.% of Si for the purpose of providing fluidity. However, if the content of Si is 12 wt.% or more, initial crystalline Si is crystallized to reduce the strength. Therefore, the content is preferably 12 wt.% or less. Furthermore, Na (metal) or Na flux is added to the molten metal of the Al-Gd-Si alloy for casting, so as to refine eutectic Si and thereby improve elongation (Modification).

If the Al-Gd-Mg alloy according to the third invention contains a large amount of Si, formability is deteriorated. Therefore, the content of Si is preferably 1 wt.% or less.

Zn is an element for providing strength and high-temperature strength. If the content of Zn exceeds 5 wt.%, general corrosion resistance and corrosion resistance such as stress corrosion cracking resistance are remarkably deteriorated. Further, casting crack and weld crack are generated. Therefore, the content of Zn is limited to 5 wt.% or less, preferably 1 wt.% or less.

Cu is an element for providing strength and high-temperature strength. If the content of Cu exceeds 5 wt.%, general corrosion resistance and corrosion resistance such as stress corrosion cracking resistance are remarkably deteriorated. Further, casting crack and weld crack are generated. Therefore, the content of Cu is limited to 5 wt.% or less. The content of Cu is preferably at least 0.1 wt.%. In application to casting, the content is suppressed as little as possible in such an amount as not to affect the castability. In the Al-Gd-Mg alloy (third invention) and the Al-Gd-Si alloy (fourth invention), the content of Cu is preferably 1 wt.% or less.

Mn, Cr, Zr and V are elements for improving strength, toughness, corrosion resistance and high-temperature strength. If the contents of Mn, Cr, Zr and V exceed 2 wt.%, 1 wt.%, 1 wt.% and 1 wt.%, respectively, a giant crystallized compound is formed to deteriorated the toughness, corrosion resistance and weldability. Therefore, the contents of Mn, Cr, Zr and V are limited to 2 wt.% or less, 1 wt.% or less, 1 wt.% or less and 1 wt.% or less, respectively. Preferably, the contents of Mn, Cr, Zr and V are limited to 1 wt.% or less, 0.3 wt.% or less, 0.3 wt.% or less, and 0.3 wt.% or less, respectively. However, since Cr is radioactive, it is preferable to exclude Cr unless it is necessarily contained.

Ti is an element effective for finely dividing the structure of an ingot to thereby prevent casting crack and improve toughness. If the content of Ti exceeds 1 wt.%, a crystallized compound of $Al_3Ti$ is increased to deteriorate the toughness. Therefore, the content of Ti is limited to 1 wt.% or less, preferably 0.5 wt.% or less. Further, the content of Ti is adjusted by adding to the molten metal an Al-Ti intermediate alloy, Al-Ti-B intermediate alloy or Ti-containing flux.

Ni is an element for providing strength, and particularly effective for improving heat resistance and high-temperature strength due to decay heat. If the content of Ni exceeds 3 wt.%, the effect is saturated, and formability such as rolling and extrusion as well as corrosion resistance is deteriorated. Therefore, the content of Ni is limited to 3 wt.% or less, preferably 2 wt.% or less.

In addition to the aforementioned components, 1 wt.% or less of Fe and 0.5 wt.% or less of other elements may be contained as impurities, wherein the characteristics of the aluminium alloy according to the present invention are not influenced at all.

The following is a method of producing the Al-Gd-Mg alloy for an wrought material according to the third invention.

If an equi-axed crystal of a crystal grain in an ingot of the aluminium alloy having the aforementioned components and composition is of 5 mm or less, the crystallized compound is not uniformly dispersed, and high-temperature strength is reduced. Further, castability and formability such as rolling and extrusion are deteriorated.

If a homogenizing temperature is less than 400° C. and more than 550° C., the high-temperature strength is reduced. If a homogenizing time is less than 2 hours, the effect is not exhibited, and the formability such as rolling and extrusion is deteriorated.

Therefore, the size of the crystal grain in the ingot of the aluminium alloy is limited to 5 mm or less, and the homogenizing should be carried out at a temperature of 400°-550° C. for 2 hours or more.

The present invention will be more clearly understood with reference to the following examples.

(Example 1)

Aluminium alloy ingots (50 mm thickness) having the components and compositions as shown by No. 1-No. 18 in Table 1 (No. 1-No. 4: first invention; No. 5-No. 15: second invention; and No. 16-No. 18: Al-B alloy for comparison) were homogenized at 450° C. for 24 Hrs. Then, the ingots were hot-rolled to prepare plates having a thickness of 3 mm. Then, the plates were annealed at 350° C. for 2 Hrs. to prepare test pieces.

Table 2 shows measurement results of thermal neutron absorptivity, mechanical property, corrosion resistance (immersion in the water for one month), and weldability (weld cracking) with use of the test pieces.

As will be apparent from Table 2, the aluminium alloy according to the first and the second invention is superior in thermal neutron absorptivity to the Al-B alloy in the comparison, and has improved characteristics for a structural material such as mechanical property, corrosion resistance and weldability.

(Example 2)

Aluminium alloy molten metals having the components and compositions as shown by No. 1-No. 12 in Table 3 (No. 1-No. 9: second invention; and No. 10-No. 12: comparison) were cast in a cast iron (20 t×200 W×300 H) at 100° C. to prepare test pieces.

Casting temperatures are 850° C. for No. 6, 950° C. for Nos. 10 and 11, and 750° C. for the others. The test piece of No. 12 is a casting having a thickness of 20 mm prepared by casting a sintered material of $B_4C$ and Cu with a molten metal of Al-12 wt.% Si at a temperature of 750° C. The content of B is 20 wt.%.

Table 3 shows measurement results of thermal neutron absorptivity, strength, corrosion resistance (immersion in the water for one year) and castability with use of the test pieces.

As will be apparent from Table 3, the aluminium alloy according to the second invention is superior in thermal neutron absorptivity, castability, mechanical property and corrosion resistance to the test pieces in the comparison.

(Example 3)

This example is concerned with the Al-Gd-Mg alloy for an extended material according to the third invention.

Aluminium alloys having the components and compositions as shown in Table 4 were molten and cast by an ordinary method to prepare aluminium alloy ingots having a thickness of 50 mm and a crystal grain size of 1 mm. Then, the ingots were homogenized at 450° C. for 12 hours, and were hot-rolled to prepare plates of 5 mm thickness.

Then, the plates were annealed at 350° C. for 2 hrs. to prepare test pieces.

By using the test pieces, thermal neutron absorptivity and mechanical property at a temperature of 250° C. were investigated as shown in Table 4.

As will be apparent from Table 4, the Al-Gd-Mg alloy according to the third invention is superior in thermal neutron absorptivity and mechanical property at high temperatures to the alloys in the comparison.

(Example 4)

The aluminium alloy ingots (50 mm thickness) of No. 2 and No. 6 shown in Table 4, having different crystal grain sizes were homogenized at 350°-600° C. Then, the ingots were hot-rolled to prepare plates of 5 mm thickness. Then, the plates were annealed at 350° C. for 2 hrs. to prepare test pieces.

By using the test pieces, thermal neutron absorptivity and mechanical property at a temperature of 250° C. were investigated as shown in Table 5.

As will be apparent from Table 5, the thermal neutron absorptivity is almost in the same level between the present invention and the comparison wherein the crystal grain size and the homogenizing time are outside the specified range as mentioned in the method of producing the aluminium alloy of the present invention. However, the mechanical property in the comparison is remarkably inferior to the present invention.

(Example 5)

This example is concerned with the Al-Gd-Si alloy for casting according to the fourth invention.

Aluminium alloys having the components and compositions shown in Table 6 were molten and cast to prepare test pieces, and various tests were carried out. The test pieces of No. 1-No. 7 are the aluminium alloys of the fourth invention, and the test pieces of No. 8-No. 10 in the comparison are Al-9Si-2.5Gd alloy, Al-10Si-2.5B alloy and Al-11.5Si alloy, respectively. The test results were shown in Table 6.

As will be apparent from Table 6, the aluminium alloys of the fourth invention is superior in thermal neutron absorptivity as shown in FIG. 1 as compared with the Al-B-Si alloy (No. 9). Further, mechinability, corrosion resistance and molten metal fluidity are also improved. In comparison with the Al-11.5Si alloy (No. 10), the molten metal fluidity and corrosion resistance are in the same level.

Furthermore, comparing the Al-9Si-2.5Gd-0.3Mg alloy (No. 5), Al-9Si-2.5Gd-0.3Mg-0.3Cu alloy (No. 2), and Al-9Si-2.5Gd alloy (No. 8) with each other, it will be appreciated that Mg contributes to the improvement in tensile strength and yield strength by 1.5 kgf/mm$^2$ or more, and that Cu contributes to the improvement in the tensile strength and the yield strength.

As will be apparent from Table 6, the aluminium alloy (No. 1-No. 7) of the fourth invention are superior in high-temperature strength.

As is described above, the aluminium alloy according to the present invention is superior in thermal neutron absorptivity as well as material characteristics for a structural material such as mechanical property, high-temperature strength, corrosion resistance and weldability. Furthermore, the aluminium alloy is superior in castability, extendability and formability. Particularly, the superior castability causes less cavity and beautiful surface of casting. As a result, a running cost may be greatly reduced, and a structure may be easily manufactured.

TABLE 1

| No. | Chemical composition (wt. %) Gd | B | Mg | Si | Zn | Cu | Ti | Others | Remarks |
|---|---|---|---|---|---|---|---|---|---|
| Aluminum alloy of the present invention | | | | | | | | | |
| 1 | 1.0 | | | | | | 0.1 | | Corresponding to the first invention |
| 2 | 3.5 | | | | | | " | | |
| 3 | 10 | | | | | | " | | |
| 4 | 20 | | | | | | " | | |
| 5 | 1.0 | 1.0 | | | | | — | | Corresponding to the second invention |
| 6 | 3.5 | 2.0 | | | | | — | | |
| 7 | 3.5 | | 4.0 | | | | 0.05 | Zr 0.3, Mn 0.7 | |
| 8 | 3.5 | | 1.0 | 0.7 | | | 0.05 | Zr 0.1, Cr 0.1 | |
| 9 | 3.5 | | | 12 | | | " | | |
| 10 | 3.5 | | 1.0 | | 4.5 | | " | Mn 0.3, Zr 0.1 | |
| 11 | 3.5 | | 1.0 | | | 4.0 | " | Mn 0.4, Zr 0.1 | |
| 12 | 3.5 | | 3.0 | | | | " | V 0.5, Mn 0.3 | |
| 13 | 3.5 | | 3.0 | | | | " | Zr 0.1, Li 1.0 | |
| 14 | 3.5 | | 1.0 | | | 3.5 | " | Ni 2, Mn 0.2 | |
| 15 | 3.5 | | 1.0 | | | | | Mn 1.2 | |
| Comparison | | | | | | | | | |
| 16 | | 3.0 | | | | | — | | Al—B alloy |
| 17 | | 2.0 | 3.5 | | | | — | Mn 1, Zn 0.5, Zr 0.2 | |
| 18 | | 3.0 | | 12 | | | — | | |

TABLE 2

| No. | Thermal neutron absorptivity*1 | Mechanical property $\sigma_B$ (kg/mm²) | $\sigma_{0.2}$ (kg/mm²) | δ (%) | Corrosion resistance*2 | Weldability*3 |
|---|---|---|---|---|---|---|
| Aluminum alloy of the present invention | | | | | | |
| 1 | ○ | 10 | 5 | 40 | A | A |
| 2 | ◎ | 15 | 7 | 32 | B | A |
| 3 | ◎ | 21 | 10 | 25 | C | B |
| 4 | ◎ | 30 | 15 | 18 | C | B |
| 5 | ○~◎ | 11 | 5 | 30 | B | B |
| 6 | ○~◎ | 15 | 8 | 25 | C | B |
| 7 | ◎ | 34 | 19 | 20 | B | A |
| 8 | ◎ | 18 | 9 | 25 | B | A |
| 9 | ◎ | 19 | 8 | 20 | B | B |
| 10 | ◎ | 24 | 13 | 18 | C | C |
| 11 | ◎ | 21 | 9 | 20 | C | C |
| 12 | ◎ | 27 | 17 | 22 | C | A |
| 13 | ◎ | 29 | 18 | 23 | C | A |
| 14 | ◎ | 18 | 9 | 20 | C | B |
| 15 | ◎ | 22 | 10 | 21 | B | A |
| Comparison | | | | | | |
| 16 | ● | 10 | 4 | 25 | C | C |
| 17 | Δ | 22 | 11 | 18 | C | C |
| 18 | ● | 15 | 6 | 15 | C | C |

*1Macroscopic thermal neutron absorbing cross section (l/cm)◎> 20 ≧ ◎ ≧ 10 ≧ ○ ≧ 5 ≧ ● ≧ 3 ≧ Δ
*2Superior A > B > C,
*3Superior A > B > C

TABLE 3

| No. | Chemical composition (wt. %) Gd | B | Si | Mg | Ti | Others | Thermal neutron absorptivity*1 | Castability*2 | Mechanical property $\sigma_B$ (Kg/mm²) | δ (%) | Corrosion resistance | Remarks |
|---|---|---|---|---|---|---|---|---|---|---|---|---|
| Present invention | | | | | | | | | | | | |
| 1 | 1.0 | — | 12 | — | 0.1 | — | ○ | A | 21 | 7 | B | Corresponding to the second invention |
| 2 | 3.5 | — | 5 | — | " | — | ◎ | A | 18 | 10 | B | |
| 3 | 3.5 | — | 7 | — | " | — | ◎ | A | 19 | 8 | B | |
| 4 | 3.5 | — | 12 | — | " | — | ◎ | A | 25 | 6 | B | |

TABLE 3-continued

| | | | | | | | | | | | |
|---|---|---|---|---|---|---|---|---|---|---|---|
| 5 | 3.5 | — | 14 | — | " | — | ◉ | B | 20 | 5 | B |
| 6 | 3.5 | 1.0 | 12 | — | " | — | ○~◉ | B | 24 | 5 | B |
| 7 | 3.5 | — | — | 4.0 | " | Mn 0.4 | ◉ | A | 26 | 14 | A |
| 8 | 3.5 | — | — | — | " | Cu 4.0 | ◉ | B | 18 | 8 | C |
| 9 | 20 | — | 12 | — | " | — | ⊙ | A | 27 | 5 | B |
| Comparison | | | | | | | | | | | |
| 10 | — | 2.5 | 12 | — | " | — | ● | C | 15 | 4 | C |
| 11 | — | 4.5 | 12 | — | " | — | ○ | D | 14 | 3 | C |
| 12 | — | 20 | 12 | — | " | — | ◉ | A | 18 | 1 | C |

| | ⊙ | ◉ | ○ | ● |
|---|---|---|---|---|
| *1Macroscropic thermal neutron absorbing cross section (1/cm) | >20 | 20~10 | 10~5 | 5~3 |

*2Order of less cavity and better fluidity of molten metal A > B > C > D.
*3Superior A > B > C.

TABLE 4

| No. | Chemical composition (wt %) Gd | Mg | Mn | Cr | Zr | V | Ti | Others | Al | Thermal neutron absorptivity*1 | Mechanical property at 250° C.*2 $\sigma_B$ (kg/mm²) | $\sigma_{0.2}$ (kg/mm²) | δ (%) | Remarks |
|---|---|---|---|---|---|---|---|---|---|---|---|---|---|---|
| Present invention | | | | | | | | | | | | | | |
| 1 | 1.0 | 2.5 | 0.3 | — | 0.1 | — | 0.05 | — | Bal. | ○ | 14 | 10 | 79 | Corresponding to the third invention |
| 2 | 3.5 | " | " | — | " | — | " | — | " | ◉ | 15 | 11 | 73 | |
| 3 | 10 | " | " | — | " | — | " | — | " | ○ | 14 | 10 | 70 | |
| 4 | 20 | " | " | — | " | — | " | — | " | ○ | 14 | 10 | 68 | |
| 5 | 3.5 | 1 | " | — | " | — | " | — | " | ◉ | 10 | 7 | 85 | |
| 6 | 3.5 | 5 | " | — | " | — | " | — | " | ◉ | 18 | 14 | 64 | |
| 7 | 3.5 | 2.5 | " | 0.1 | — | — | " | — | " | ◉ | 14 | 10 | 75 | |
| 8 | 3.5 | 2.5 | " | — | — | 0.1 | " | — | " | ◉ | 13 | 10 | 78 | |
| 9 | 2.0 | 2.5 | 0.3 | — | 0.1 | — | " | B 1.0 | " | ○~◉ | 19 | 10 | 70 | |
| 10 | 2.0 | 2.5 | 0.3 | — | 0.1 | — | 0.1 | Li 1.0 | " | ○~◉ | 15 | 12 | 50 | |
| 11 | 3.5 | 2.5 | 0.3 | — | 0.1 | — | " | Si 0.5 | " | ◉ | 15 | 12 | 60 | |
| 12 | 3.5 | 2.5 | 0.3 | — | 0.1 | — | " | Zn 0.5 | " | ◉ | 15 | 12 | 73 | |
| 13 | 3.5 | 2.5 | 0.3 | — | 0.1 | — | " | Cu 0.5 | " | ◉ | 15 | 12 | 70 | |
| 14 | 3.5 | 2.5 | 0.3 | — | 0.1 | — | " | Ni 1.0 | " | ◉ | 16 | 13 | 65 | |
| Comparison | | | | | | | | | | | | | | |
| 15 | — | — | — | — | — | — | — | B 3.0 | " | ● | 5 | 3 | 45 | |
| 16 | — | — | 0.3 | — | 0.1 | — | — | B 3.0 | " | ● | 6 | 4 | 50 | |
| 17 | — | 2.5 | 0.3 | — | 0.1 | — | — | B 3.0 | " | ● | 14 | 10 | 40 | |
| 18 | 3.5 | — | 0.3 | — | 0.1 | — | — | — | " | ○ | 6 | 4 | 60 | |

*1Macroscopic thermal neutron absorbing cross section (1/cm)○> 20, 20 ≧ ●> 10, 10 ≧ ○> 5, 5 ≧ ●> 3.
*2Mechanical property at 250° C.: Tensile strength after retention for 1 hour at 250° C.; Gauge length of test piece is 16 mm.

TABLE 5

| No. | Size of crystal grain of ingot (mm) | Homogenizing condition (°C. × hr.) | Thermal neutron absorptivity*1 | Mechanical property at 250° C.*2 $\sigma_B$ (kg/mm²) | $\sigma_{0.2}$ (kg/mm²) | δ (%) | Remarks |
|---|---|---|---|---|---|---|---|
| Present invention | | | | | | | |
| 2 | 0.5 | 420 × 24 | ◉ | 15 | 12 | 72 | Corresponding to the third invention. |
| | 1 | 420 × 24 | ◉ | 15 | 11 | 67 | |
| | 1 | 500 × 24 | ◉ | 15 | 12 | 73 | |
| | 1 | 540 × 12 | ◉ | 14 | 10 | 65 | |
| | 3 | 500 × 24 | ◉ | 14 | 10 | 60 | |
| 6 | 0.5 | 420 × 24 | ◉ | 19 | 14 | 67 | |
| | 3 | 500 × 24 | ◉ | 17 | 13 | 70 | |
| Comparison | | | | | | | |
| 2 | 6 | 420 × 24 | ◉ | 13 | 9 | 50 | |
| | 1 | 350 × 24 | ◉ | 12 | 9 | 51 | |
| | 1 | 580 × 12 | ◉ | 12 | 8 | 75 | |
| 6 | 6 | 580 × 12 | ◉ | 15 | 12 | 69 | |
| | 1 | 580 × 12 | ◉ | 17 | 13 | 60 | |

*1Macroscopic thermal neutron absorbing cross section (1/cm)⊙> 20, 20 ≧ ◉> 10, 10 ≧○> 5, 5 ≧ ●> 3
*2Mechanical property at 250° C.: Tensile strength after retention for 1 hour at 250° C.; Gauge length of test piece is 16 mm.

TABLE 6

| No. | Chemical composition (wt. %) Si | Gd | Mg | Cu | B | Ti | Al | Room temp. strength $\sigma_B$ (kgf/mm²) | $\sigma_y$ (kgf/mm²) | δ (%) | High temp. strength (200° C.) $\sigma_B$ (kgf/mm²) | $\sigma_y$ (kgf/mm²) | δ (%) |
|---|---|---|---|---|---|---|---|---|---|---|---|---|---|
| Present | | | | | | | | | | | | | |

TABLE 6-continued

| | | | | | | | | | | | | | |
|---|---|---|---|---|---|---|---|---|---|---|---|---|---|
| invention | | | | | | | | | | | | | |
| 1 | 9 | 0.5 | 0.3 | 0.3 | — | — | Bal. | 18.9 | 9.2 | 9.5 | 15.8 | 9.5 | 8.5 |
| 2 | 9 | 2.5 | 0.3 | 0.3 | — | — | " | 19.3 | 9.8 | 7.0 | 16.2 | 9.8 | 7.0 |
| 3 | 9 | 5 | 0.3 | 0.3 | — | — | " | 19.8 | 10.1 | 5.5 | 16.5 | 10.1 | 6.5 |
| 4 | 9 | 8 | 0.3 | 0.3 | — | — | " | 18.5 | 9.5 | 4.5 | 15.3 | 9.2 | 5.5 |
| 5 | 9 | 2.5 | 0.3 | — | — | — | " | 17.4 | 8.9 | 7.5 | 13.3 | °7.5 | 8.5 |
| 6 | 9 | 2.5 | — | 0.3 | — | — | " | 18.3 | 9.3 | 7.0 | 15.5 | 9.3 | 7.5 |
| 7 | 9 | 2.5 | 0.3 | 0.3 | 0.003 | 0.08 | " | 19.2 | 9.7 | 7.5 | 16.3 | 9.7 | 7.0 |
| Comparison | | | | | | | | | | | | | |
| 8 | 9 | 2.5 | — | — | — | — | " | 15.8 | 7.2 | 7.0 | 9.8 | 6.6 | 12.0 |
| 9 | 10 | — | — | — | 2.5 | — | " | 14.2 | 9.2 | 4.0 | 9.1 | 6.3 | 6.0 |
| 10 | 11.5 | — | — | — | 0.004 | 0.08 | " | 18.9 | 9.0 | 11.5 | 13.1 | 7.6 | 13.5 |

| No. | Microscopic thermal neutron absorbing cross section (l/cm) | Castability*1 | Corrosion resistance*2 | Machinability*3 | Remarks |
|---|---|---|---|---|---|
| Present invention | | | | | |
| 1 | 2.4 | A | A | A | Corresponding to the fourth invention |
| 2 | 12.1 | A | A | B | |
| 3 | 24.6 | B | A | B | |
| 4 | 40.4 | B | A | B | |
| 5 | 12.1 | A | A | B | |
| 6 | 12.1 | A | A | B | |
| 7 | 12.1 | A | A | B | |
| Comparison | | | | | |
| 8 | 12.1 | A | A | B | |
| 9 | 2.8 | C | C | C | |
| 10 | 0 | A | A | A | |

*1,2,3Good, A → B → C Inferior

What is claimed is:

1. An aluminium alloy with superior thermal neutron absorptivity, consisting essentially of 0.2–30 wt.% of Gd, and at least one selected from the group consisting of 3 wt.% or less of B, 2 wt.% or less of Li, 6 wt.% or less of Mg, 15 wt.% or less of Si, 5 wt.% or less of Cu, 5 wt.% or less Zn, 2 wt.% or less of Mn, 1 wt.% or less of Cr, 1 wt.% or less of Zr, 1 wt.% or less of V, 1 wt.% or less of Ti, and 3 wt.% or less Ni.

2. An aluminium alloy for an wrought material with superior high-temperature strength and thermal neutron absorptivity, consisting essentially of 0.2–20 wt.% of Gd, 0.5–6 wt.% of Mg, at least one selected from the group consisting essentially of 2 wt.% or less of B, 2 wt.% or less of Li, 1 wt.% or less of Si, 1 wt.% or less of Cu, 1 wt.% or less of Zn, 1 wt.% or less of Mn, 0.3 wt.% or less of Cr, 0.3 wt.% or less of Zr, 0.3 wt.% or less of V, 0.5 wt.% or less of Ti, and 2 wt.% or less of Ni, and a balance of Al and impurities.

3. An aluminium alloy for casting with superior high-temperature strength and thermal neutron absorptivity, containing 0.2–10 wt.% of Gd, 6–12 wt.% of Si, at least one selected from the group consisting of 1.0 wt.% or less of Mg and 1.0 wt.% or less of Cu, and a balance of Al and impurities.

* * * * *